US011046466B2

(12) United States Patent
Fildes et al.

(10) Patent No.: US 11,046,466 B2
(45) Date of Patent: Jun. 29, 2021

(54) APPARATUS FOR TENSIONING A CABLE LACING TAPE DEVICE

(71) Applicant: DANIELS MANUFACTURING CORPORATION, Orlando, FL (US)

(72) Inventors: Trevor D. Fildes, Sycamore, IL (US); James W. Tyrrell, Belvidere, IL (US); Edward T. Eaton, Eola, IL (US); Alan E. Zantout, Sycamore, IL (US); Michael R. Weiby, Bartlett, IL (US); Randal E. Hoffman, Wasco, IL (US)

(73) Assignee: DANIELS MANUFACTURING CORPORATION, Orlando, FL (US)

( * ) Notice: Subject to any disclaimer, the term of this patent is extended or adjusted under 35 U.S.C. 154(b) by 143 days.

(21) Appl. No.: 16/201,650

(22) Filed: Nov. 27, 2018

(65) Prior Publication Data

US 2019/0161220 A1 May 30, 2019

Related U.S. Application Data

(60) Provisional application No. 62/703,993, filed on Jul. 27, 2018, provisional application No. 62/590,845, filed on Nov. 27, 2017.

(51) Int. Cl.
*B65B 13/22* (2006.01)
*B65B 13/02* (2006.01)
(Continued)

(52) U.S. Cl.
CPC ..... *B65B 13/22* (2013.01); *B65B 13/027* (2013.01); *B65B 13/185* (2013.01); *B65B 13/24* (2013.01)

(58) Field of Classification Search
CPC ..... B65B 13/22; B65B 13/24; B65B 13/185; B65B 13/027; B65B 13/025; B65B 7/14
See application file for complete search history.

(56) References Cited

U.S. PATENT DOCUMENTS 3,735,784 A 5/1973 Obuch et al.
4,064,918 A 12/1977 Pobuta et al.
(Continued)

FOREIGN PATENT DOCUMENTS

EP 0521199 A1 * 1/1993 ..... B65B 13/027
EP 0521199 A1 1/1993

OTHER PUBLICATIONS

ISA/US, International Search Report and Written Opinion issued for International Application No. US2016015391, dated Mar. 29, 2016, 9 pages.
(Continued)

*Primary Examiner* — Adam J Eiseman
*Assistant Examiner* — Mohammed S. Alawadi
(74) *Attorney, Agent, or Firm* — Matthew G. McKinney, Esq.; Allen, Dyer et al.

(57) ABSTRACT

An apparatus for tensioning a cable tape comprises a housing, a drive assembly, a capstan, and an optional cutting device. The drive assembly includes a driving member and a driven member slidably coupled to the driving member. A biasing element is coupled between the driving and the driven member and in a first operating mode, the driving member causes movement of the driven member little or no relative movement between two members. The capstan is rotatably coupled to the housing, and includes a gripping device to grip a cable tape and wrap the cable tape around an outer surface of the capstan as the capstan rotates. In a second operating mode, a tension force applied on the capstan by the cable tape that is greater than the biasing force allows relative movement between the driving member and the driven member.

19 Claims, 8 Drawing Sheets

(51) Int. Cl.
*B65B 13/18* (2006.01)
*B65B 13/24* (2006.01)

(56) References Cited

U.S. PATENT DOCUMENTS 4,081,002 A * 3/1978 Violi ..... B65B 13/027 140/123.6
4,328,742 A 5/1982 Discavage
4,498,506 A 2/1985 Moody et al.
4,733,701 A * 3/1988 Loisel ..... B65B 13/027 140/123.6
5,163,482 A * 11/1992 Wolcott ..... B65B 13/025 140/123.6
5,205,328 A 4/1993 Johnson
5,595,220 A * 1/1997 Leban ..... B65B 13/027 140/123.6
6,047,742 A * 4/2000 Barlasov ..... B65B 13/025 140/123.6
6,302,157 B1 10/2001 Deschenes et al.
6,648,378 B1 11/2003 Torres et al.
7,185,680 B2 3/2007 Magno, Jr.
7,231,944 B2 6/2007 Magno, Jr.
9,682,806 B2 6/2017 Zantout et al.
9,701,428 B2 7/2017 Weiby et al.
2005/0115629 A1* 6/2005 Bernard ..... B65B 13/027 140/123.5
2005/0178461 A1 8/2005 Magno, Jr. et al.
2006/0107624 A1* 5/2006 Yu Chen ..... B65B 13/025 53/592
2007/0089801 A1 4/2007 Hillegonds et al.
2008/0092981 A1* 4/2008 Hillegonds ..... B21F 9/02 140/93.4
2009/0071350 A1* 3/2009 Fay ..... B65B 13/22 100/6
2009/0242069 A1 10/2009 Segroves
2010/0139805 A1* 6/2010 Sledzinski ..... B65B 13/027 140/93.2
2012/0067450 A1* 3/2012 Shafer ..... B65B 13/027 140/123.6
2012/0291231 A1 11/2012 Ku
2016/0236804 A1* 8/2016 Weiby ..... B26D 1/065

OTHER PUBLICATIONS

ISA/US, International Search Report and Written Opinion issued on PCT application No. US18/62640, dated Mar. 27, 2019, 12 pages.
Office Action from corresponding U.S. Appl. No. 16/404,336, dated Oct. 20, 2020, 24 pages.

* cited by examiner

APPARATUS FOR TENSIONING A CABLE LACING TAPE DEVICE

CROSS REFERENCE TO RELATED APPLICATION

This application is a non-provisional application claiming priority from U.S. Provisional Application Ser. No. 62/703,993, filed Jul. 27, 2018, and U.S. Provisional Patent Application No. 62/590,845 filed Nov. 27, 2017, both entitled "Apparatus for Tensioning a Cable Lacing Tape Device," the contents of which are incorporated herein by reference in their entirety.

FIELD OF THE DISCLOSURE

The present disclosure relates generally to the installation of a cable lacing tape and more particularly to an apparatus for tensioning a cable lacing tape device.

BACKGROUND OF RELATED ART

Cable lacing tapes may be used for a variety of applications. Modern cable lacing tapes typically are a thin, relatively flat, woven, or braided cord, often referred to as a "tape", having filaments that may be made of materials such as nylon, polyester, or aramid fiber, and which may be impregnated with coatings to enhance particular performance characteristics. However, cable lacing tape has drawbacks in that the cable lacing tape typically is tied by hand in a costly, labor-intensive, and time-consuming process. Due to these problems, several attempts have been made to automate the cable lacing and tensioning process.

One such device for automated knot tying is described in U.S. Pat. No. 6,648,378. The described device includes an automatic knot-tying device for tying a discrete knot about a workpiece, such as a bundle of wires. The device works by pulling a lacing tape, transversely around the workpiece and wrapping the filament around the workpiece. A shuttle moves the filament between carriage rings and along the workpiece at the appropriate steps, and a plurality of hooks pull the filament away from the workpiece at the appropriate steps. The operation is finished by cinching, cutting, and reloading so that the resulting knot is discrete and secure. At least one drawback of the described device is that it requires a complicated mechanism to both wrap and tie a knot about the workpiece.

In still another example, International Application Number PCT/US2012/044413, describes a hand-held tool for tensioning and severing a cable tie. The device includes a reciprocating tensioning mechanism such as a pawl link for tensioning the cable tie tail, a locking mechanism to prevent further tensioning upon the attainment of a preselected tension level in the tie tail, and a severing device to sever the tie tail from the cable tie head once installed.

Yet another example is U.S. Pat. No. 9,701,428, which is discloses an apparatus for tensioning a material including a housing, a spur shaft reciprocally coupled to the housing, a trigger operably coupled to the housing and to the spur shaft to effect translation of the spur shaft when the trigger is operably moved, a tensioning device mounted to the housing and operably coupled to the spur shaft such that translation of the spur shaft causes operation of the tensioning device, and a passage having an inlet and an outlet, the passage operably coupling the inlet and outlet to the tensioning device.

DETAILED DESCRIPTION

The following disclosure of example methods and apparatus is not intended to limit the scope of the disclosure to the precise form or forms detailed herein. Instead the following disclosure is intended to be illustrative so that others may follow its teachings.

U.S. Patent Application Publication No. 2015/0267844 and U.S. Pat. No. 9,682,806, each of which is incorporated herein by reference in its entirety, both generally disclose a cable lacing tie for holding a plurality of objects together. The disclosed cable lacing tape devices generally include a head assembly and a length of cable lacing tape that can be retained by the head assembly upon activation of the retaining device. In the disclosed example devices, a free end of the cable lacing tape is routed (generally be hand) through an opening in the head around retainer, which is actuatable from an unlocked position to a locked position by pulling the free end of the cable lacing tape with sufficient force.

In at least some instances, the example cable lacing tie devises comprise a length of woven aramid fiber tape with a synthetic rubber coating attached to a polymer fastener. While the free end must be activated with sufficient force to actuate the retainer, this tape material may be difficult to grip by hand and furthermore may be difficult to grip mechanically utilizing the standard cam action of existing cable tie guns due to the coating acting as a dry lubricant as well as the abrasive nature of the aramid fiber.

It has been found that a directional change, wrapping, and/or folding of the lace assists in the grip allowing the tool to build tension in the lace. This tension is required to both activate the retainer in the fastener head as well as activate the cutting action in the tool linkage (if available).

Figure 9:
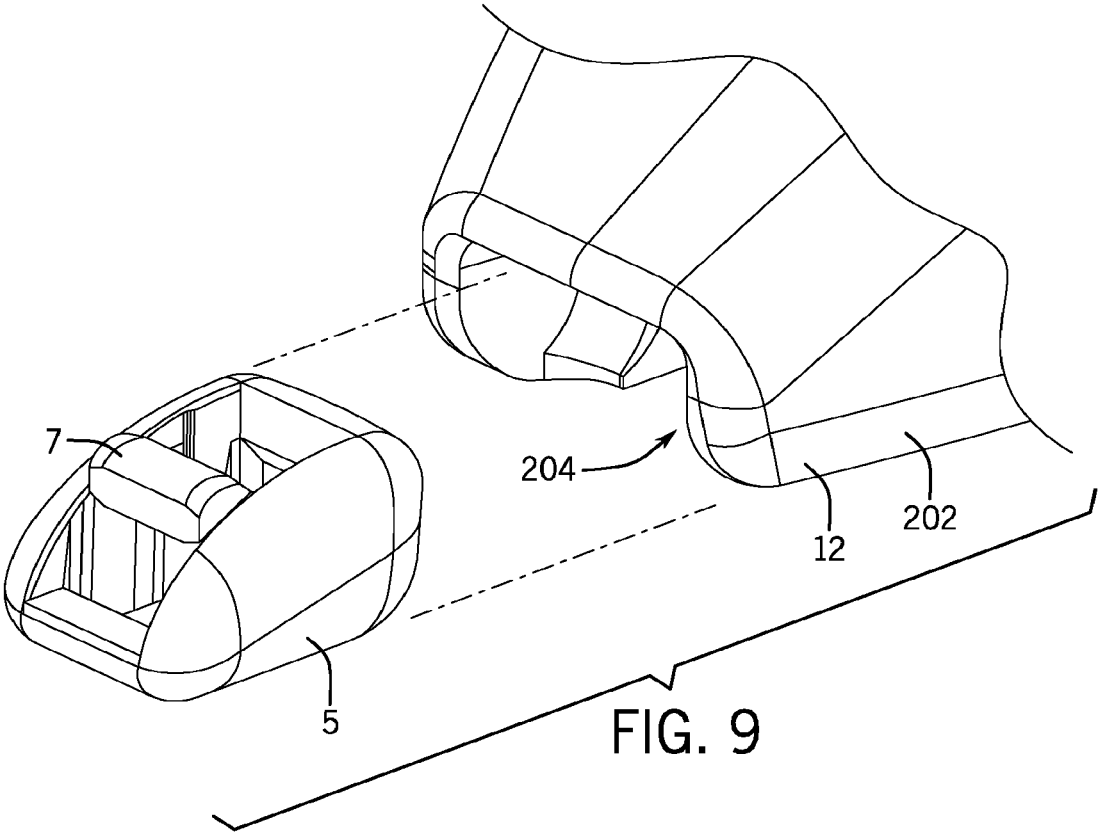
FIG. 9 is an enlarged detailed view of the front portion of the example apparatus of FIG. 1, showing the apparatus mating with an example cable lacing device.

Referring now to the figures, an example apparatus 10 for tensioning an example cable lacing tape device, such as the cable lacing tape device 5 (see FIG. 9, showing the device 5 without an associated tape), is illustrated. As described herein, the example apparatus 10 tensions the cable lacing tape device 5 to the proper predetermined tension and optionally cuts a free end of the cable lacing tape once the predetermined tension is achieved.

Figure 1:
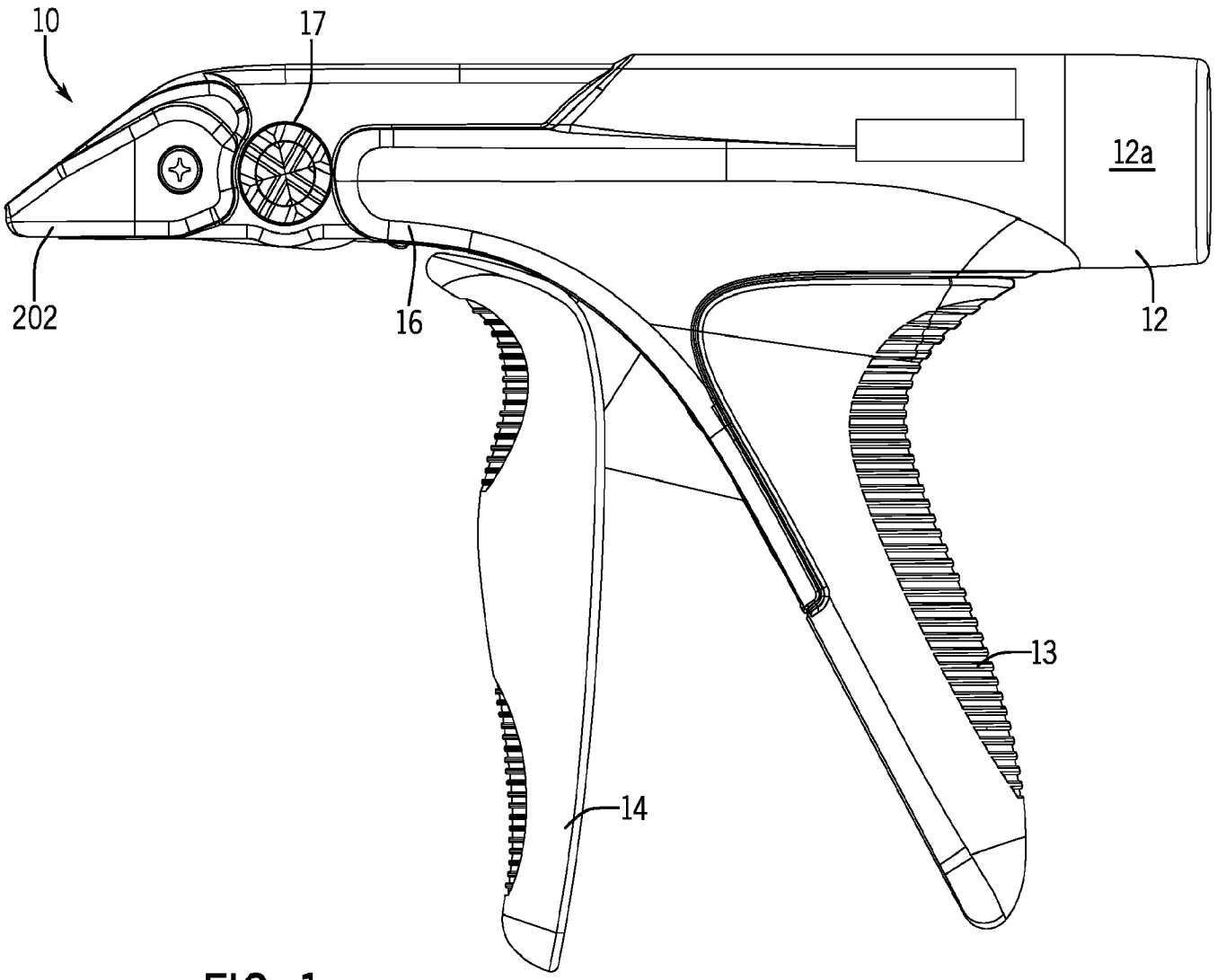
FIG. 1 is a side elevational view of an example apparatus for tensioning a cable lacing tape device as disclosed herein.
Figure 2:
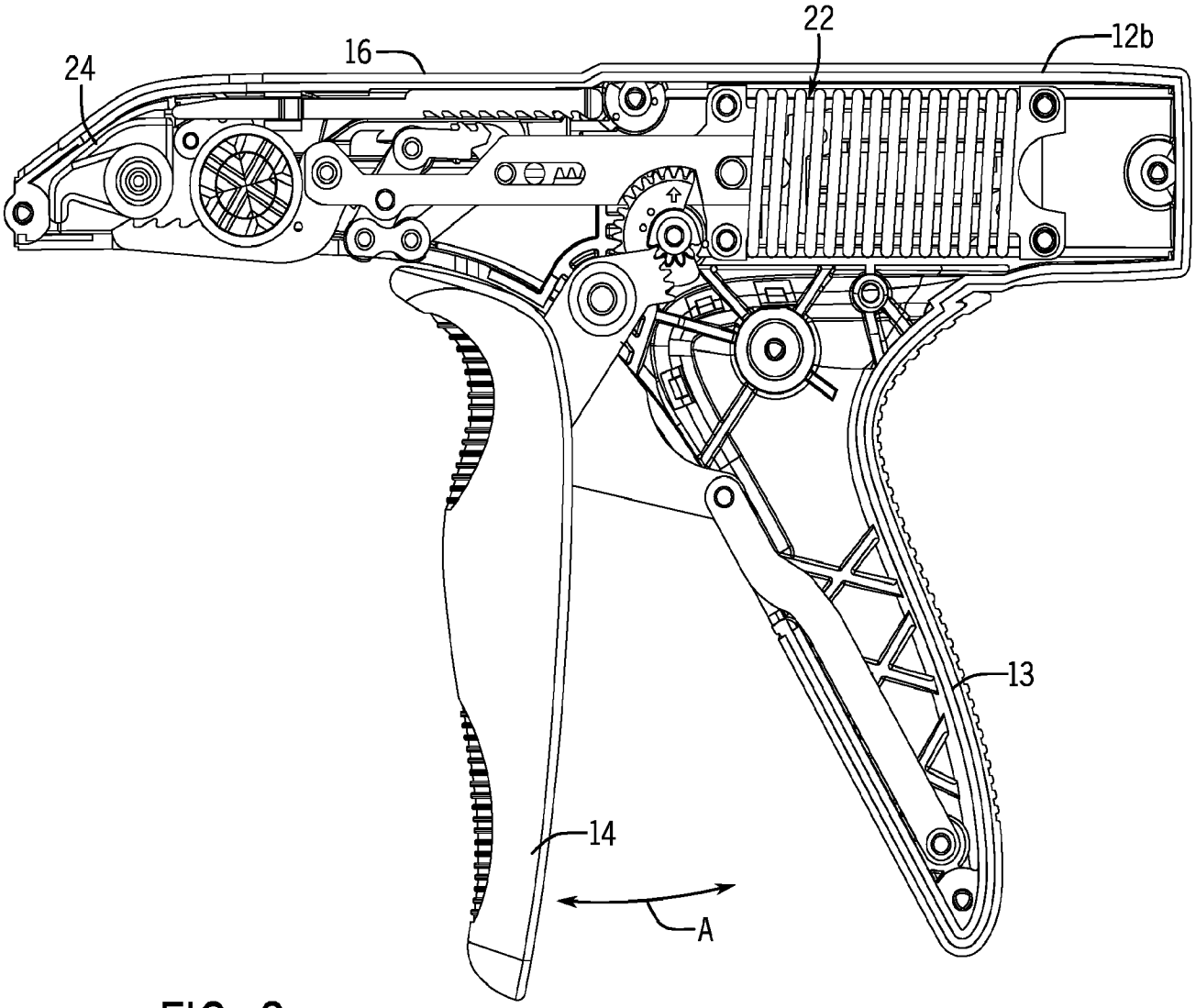
FIG. 2 is a side elevational view of the apparatus with a portion of the housing removed.

The example apparatus 10 includes a housing 12 in the general shape of a pistol or gun having a grip 13, trigger 14, and a barrel portion 16. In this example, a forward end of the barrel portion 16 includes an exposed capstan assembly 17 as will be disclosed in further detail below. As illustrated in FIG. 2, one sidewall 12*a* of the housing 12 has been cut away to show the other housing sidewall 12*b* and the internal parts and a tensioning assembly 22 of the apparatus 10.

Referring to FIG. 2, the example apparatus 10 generally comprises a manual actuating mechanism, such as the trigger 14 and the tensioning assembly 22 that typically reciprocates to operate the capstan assembly 17 but actuates a cutting head 24 once a predetermined tension in achieved. The tensioning assembly 22 is mounted within the barrel portion 16 of the housing 12.

Figure 3A:
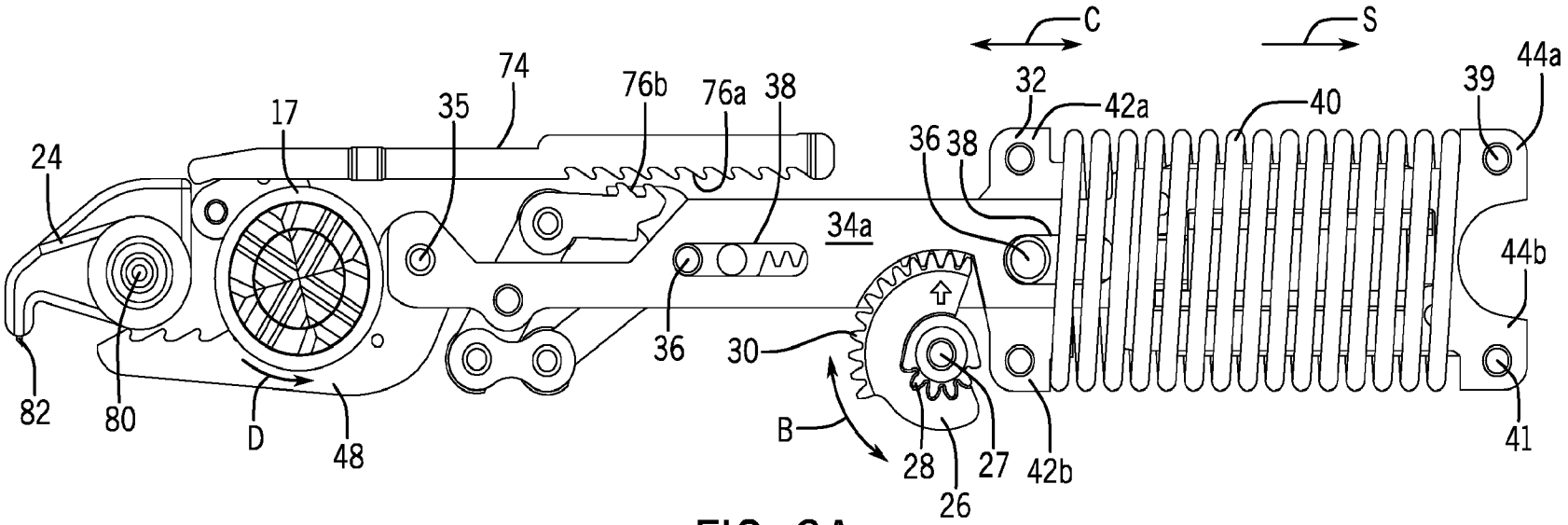
FIG. 3A is an enlarged side elevational view of the tensioning assembly of the apparatus of FIG. 1 showing the mechanism during normal operation.
Figure 4:
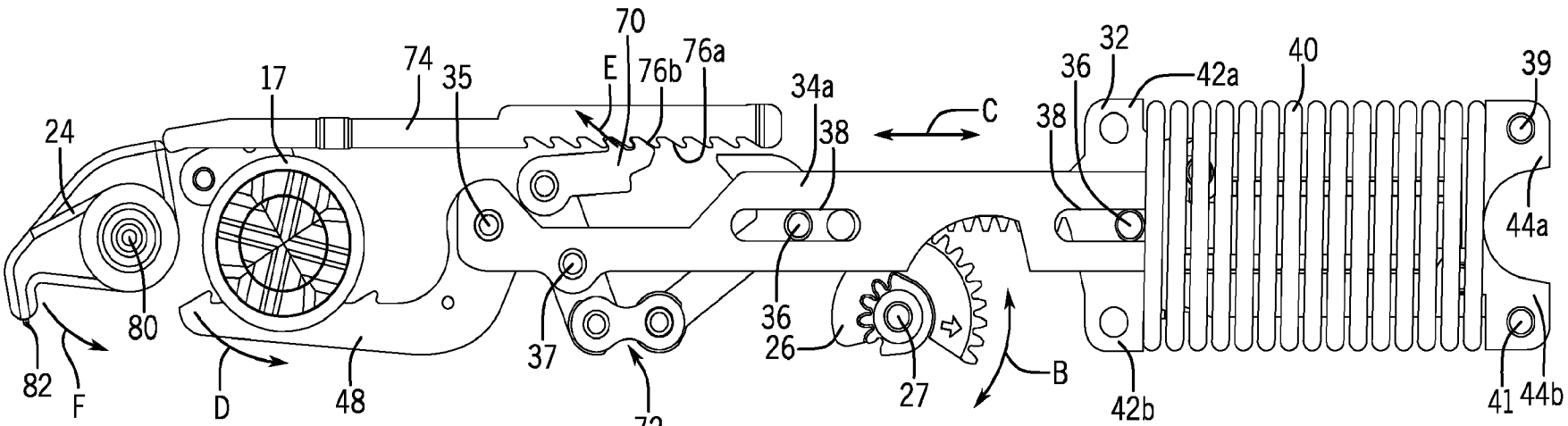
FIG. 4 is an enlarged side elevational view of the tensioning assembly of the apparatus of FIG. 1 showing the assembly during an example cutting operation.
Figure 3B:
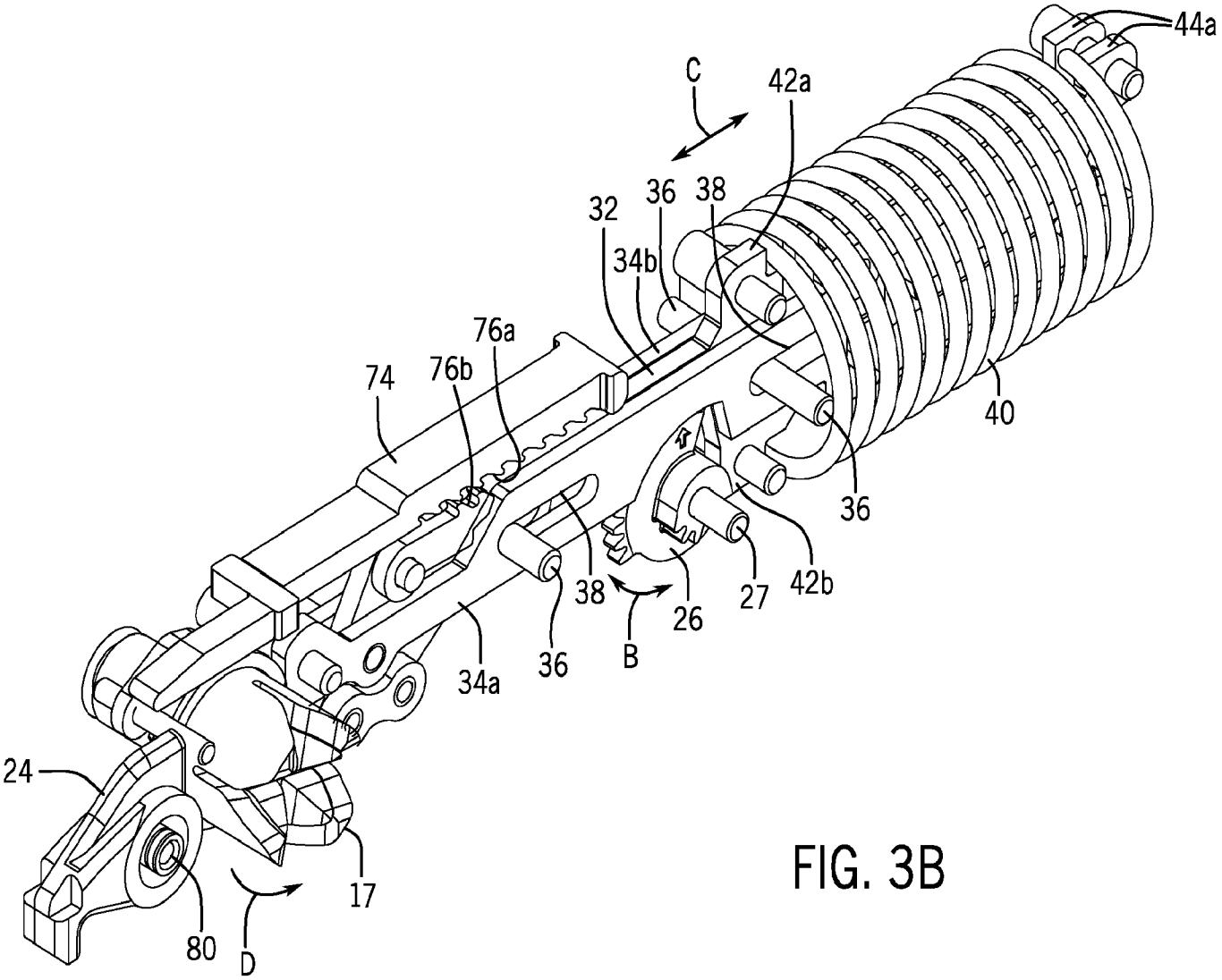
FIG. 3B is a perspective view of the tensioning assembly of FIG. 3A.

Referring to FIGS. 2-4, the example tensioning assembly 22 comprises a gear 26 rotatably coupled to the housing 12 about an axis 27 in the direction of the arrow B. The trigger 14 is pivotally coupled to the housing 12 and is operable in the direction of the arrow A to rotate the gear 26 within the housing 12. The gear 26 includes a driving gear portion 28 and a reciprocating gear portion 30. The driving gear portion 28 is operably coupled to the trigger 14. The reciprocating gear portion 30 is coupled to a correspondingly geared driving member. Therefore, movement of the gear 26 in either direction of the arrow B causes reciprocating movement of the inner plate 32 in the direction of the arrows C.

In this example, the driving member is an inner plate 32. It will be appreciated that the driving member may be any suitable element, including, for instance, a single element such as a plate, shaft, or other suitable member. In addition, although the driving member in this example is an "inner" plate, this nomenclature is for ease of understanding and it will be understood that the relative positioning (inner, outer, etc.) is merely illustrative and the driving member may be located in any suitable orientation and/or relative position related to any other element in the apparatus 10.

The example inner plate 32 is operably coupled to a driven member, such as for example, an outer plate assembly 34. As with the driving member, it will be appreciated that the driven member may be any suitable element, including, for instance, a single element such as a plate, shaft, or other suitable member. In addition, although the driven member in this example is an "outer" plate assembly, this nomenclature is also for ease of understanding and it will be understood that the relative positioning (inner, outer, etc.) is merely illustrative and the driven member may be located in any suitable orientation and/or relative position relative to any other element in the apparatus 10.

The example outer plate assembly 32 includes a pair of outer plates 34*a*, 34*b*. In this example, the inner plate 32 includes a pair of pins 36 that extend through corresponding slots 38 defined in each of the outer plates 34*a*, 34*b*. The two outer plates 34*a*, 34*b* are coupled to one another via various links, including links 35, 37, 39, and 41 to contain the inner plate 32 with the pins 36 within the slots 38. Hence, the inner plate 32 can move, e.g., slide longitudinally, relative to the outer plates 34*a*, 34*b*.

In the illustrated example, relative movement between the inner plate 32 and the outer plates 34*a*, 34*b*, is controlled by a biasing element, such as a coil spring 40. More precisely, the example coil spring 40 extends between a first pair of shoulders 42*a*, 42*b*, formed on the inner plate 32 and a second pair of shoulder 44*a*, 44*b*, formed on each of the outer plates 34*a*, 34*b*. In this arrangement, longitudinal movement of the inner plate 32 in the direction of the arrow S (see FIG. 3A) will cause the coil spring 40 to resist compression and transfer force to the outer plate assembly 34, with little or no relative movement between the inner plate 32 and the outer plate assembly 34.

An end of the outer plate assembly 34 opposite the shoulder 44*a*, 44*b*, comprises a ratcheted spur 48 coupled to the assembly 34. In this example, the spur 48 is coupled to the assembly by the link 35. As the outer plate assembly 34 reciprocates with the inner plate 32, the spur 48 likewise reciprocates in the same manner. As the spur 48 moves, the ratchets engage the rotatably mounted capstan assembly 17 through corresponding, circumferentially disposed ratchets or dogs, which are hidden from view and therefore not shown. Thus, as will be appreciated by one of ordinary skill in the art, during normal operation of the apparatus 10 (i.e., when the capstan assembly 17 is under little or no torsional load), reciprocal movement of the inner plate 32 will cause the outer plate assembly 34 to move together with the inner plate 32, and thus cause rotational movement of the capstan assembly 17.

Referring to FIGS. 5-8 and 11-12, the capstan assembly 17 is illustrated in detail. The example assembly generally comprises an inner capstan 50 and an outer capstan 52. It will be understood, however, that the capstan assembly may be one or more integrated or separate elements as desired, including a single capstan. In this example, however, the inner capstan 50 is rotatably coupled to the housing 12 and as noted above, is operably coupled to the spur 48 to rotate in the direction of the arrow D. The outer capstan 52, meanwhile circumferentially surrounds the inner capstan 50 and is rotatable about the inner capstan 50. In this example, the relative movement between the inner capstan 50 and the outer capstan 52 is limited by a pin 54 and a slot 56 arrangement. While the outer capstan 52 is independently rotatable relative to the tool, the outer capstan 52 is free to move independent only a predetermined amount of angular degrees relative to the inner capstan 50 before the inner capstan 50 and outer capstan 52 engage with each other and rotate together.

Figure 5:
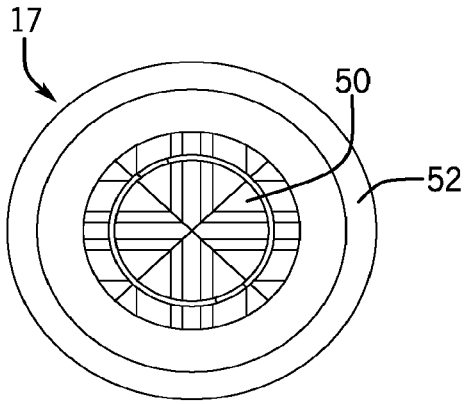
FIG. 5 is a front view of an example capstan assembly for use in the example apparatus.
Figure 6:
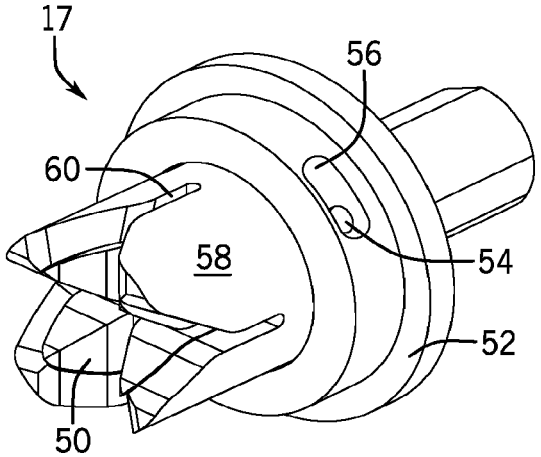
FIG. 6 is a perspective view of the example capstan assembly of FIG. 5.
Figure 7:
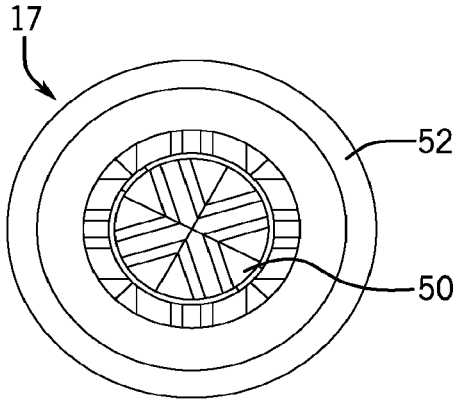
FIG. 7 is a front view of the example capstan assembly of FIG. 5, showing relative rotational displacement between an inner and an outer capstan.
Figure 8:
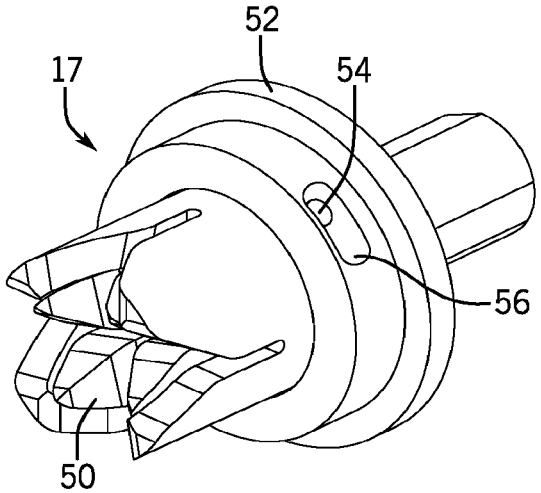
FIG. 8 is a perspective view of the example capstan assembly of FIG. 7.

Each of the inner capstan 50 and the outer capstan 52 includes a slit 60 transverse to the axis of rotation, which defines a plurality of fingers 58. In this example, each finger 58 includes chamfered surfaces 62 proximate to the slit 60 to assist in the insertion of a cable lacing tape 200 into the slits 60. In the position of FIGS. 5 and 6 the inner capstan 50 and the outer capstan 52 are rotatably arranged such that the slits 60 are in alignment. In the position of FIGS. 7 and 8 the outer capstan 52 has rotated relative to the inner capstan 50 such that the slits 60 are slightly misaligned.

Figure 11:
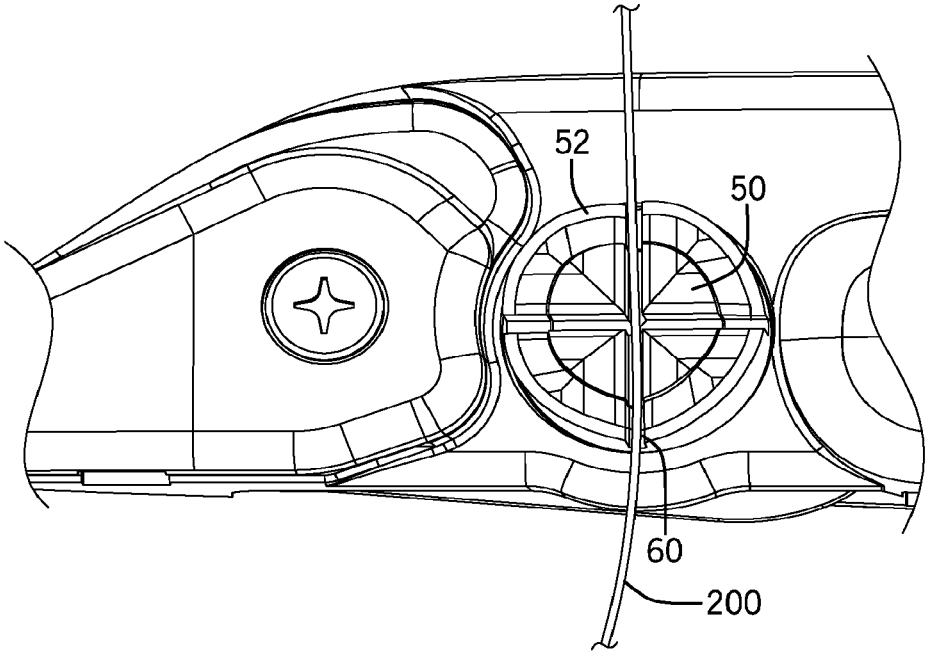
FIG. 11 is a side elevational view showing the example capstan assembly of FIG. 5 in a neutral configuration with a cable lacing tape located therein.
Figure 12:
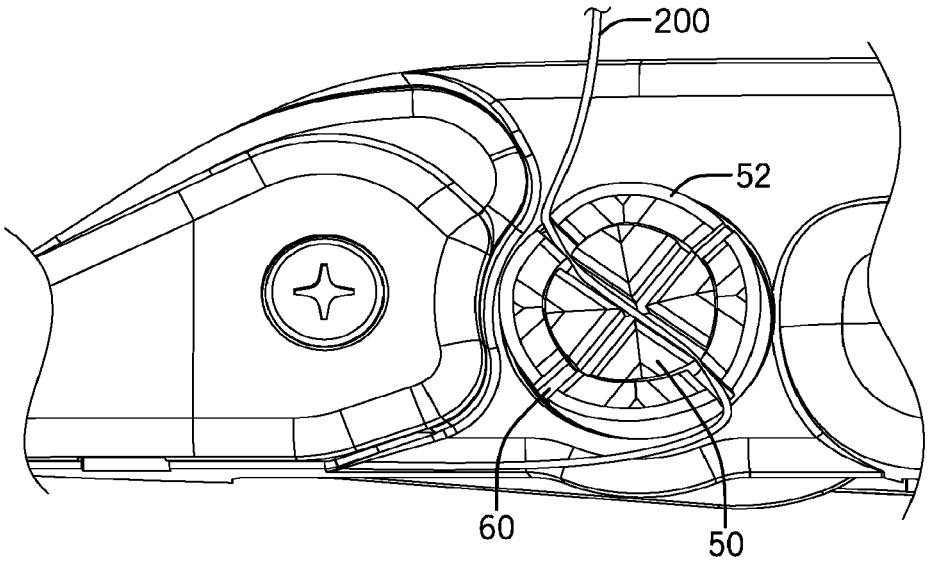
FIG. 12 is a side elevation view similar to FIG. 11, showing the example capstan assembly in a skewed position with a cable lacing tape retained therein.

As can best be seen in FIGS. 11 and 12, the lacing tape 200 is placed within the capstan assembly 17 an into the slits 60 that are aligned. As the capstan assembly 17 rotates (FIG. 12), the outer capstan 52 rotates relative to the inner capstan 50 to misalign the slits 60 and thereby pinch the lacing tape 200 between the inner capstan 50 and the outer capstan 52, preventing the lacing tape from being withdrawn from the capstan assembly 17. Accordingly, because the lacing tape 200 is securely pinched between the two capstans, further rotation of the capstan assembly 17 causes the lacing tape 200 to wind around the outer circumferential surface of the outer capstan 52.

It will be appreciated by one of or ordinary skill in the art that the lacing tape 200 may be secured in any suitable manner and not necessarily through a "pinch" hold, including for instance, a friction fit or other suitable retention means. In addition, in this example, the location and size of the pin and slot may vary as desired and may be located on either of the capstans or may be eliminated altogether. It will be further appreciated that the manner in which the relative movement between capstans is limited (if limited at all) may be differ from the manner shown.

Figure 10:
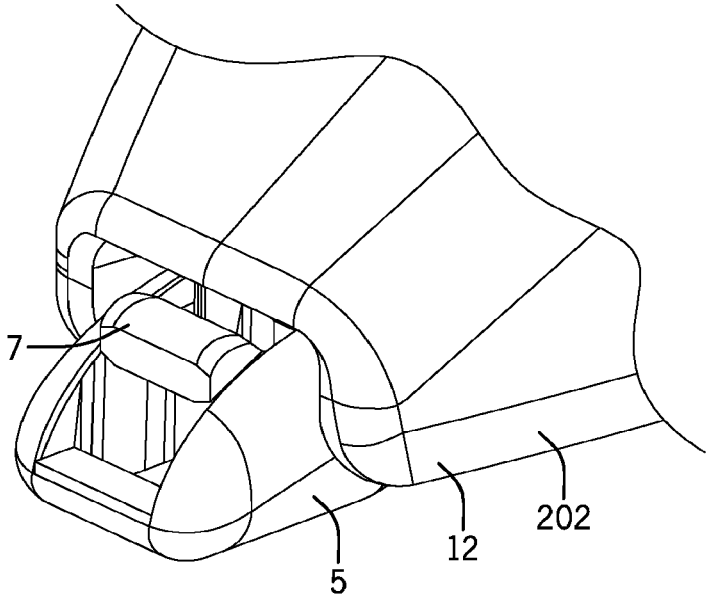
FIG. 10 is an enlarged detailed view of the front portion of the example apparatus of FIG. 1, showing the apparatus mated with the example cable lacing device.

As disclosed previously, during normal operations (e.g., a first operating mode), reciprocal movement of the inner plate 32 is coupled with movement of the outer plate assembly 34 and causes rotation of the capstan assembly 17. As the lacing tape 200 is wrapped around the outer capstan 200, and the device 5 is pressed against the housing 12 (see FIGS. 9 and 10), tension is built up on the lacing tape 200. As the tension continues to increase, further attempts to rotate the capstan assembly 17 causes a force build up in the coil spring 40. At a predetermined tension, the resistive force against rotational movement of the capstan assembly 17 is greater than the force applied between the inner plate 32 and the outer plate assembly 34 by the coil spring such that the outer plate assembly 34 no longer moves within the housing and the coil spring 40 compresses. Thus, in this second operating mode, the inner plate 32 moves relative to the stationary outer plate assembly 34.

In the example illustrated, relative movement between the inner plate 32 and the outer plate assembly 34 causes actuation of a second operating mode action, such as for instance, an activation sound, a visual indicator, or a cutting action such as an actuation of the optional cutting head 24. As illustrated in FIG. 4, the inner plate 32 is coupled to a pivoting bar 70 via a link assembly 72. The link 72 is coupled to the outer plate assembly 34 at the link 37. As such, movement of the inner plate 32 causes the pivoting bar 70 to move in the direction of the arrow E. Also illustrated in FIG. 4 is a cutting bar 74. During normal operation (FIG. 3A; the first operating mode), the cutting bar is not engaged. During relative movement between the plates 32 and 34 (FIG. 4; the second operating mode), however, the pivoting bar 70 pivots into engagement with the cutting bar 74, and with corresponding ratchets 76*a*, 76*b* on each of the pivoting bar 70 and the cutting bar 74, the cutting bar 74 is moved towards and into engagement with the cutting head 24 to pivot the cutting head 24 in the direction of the arrow F. Specifically, the cutting head 24 is pivotally mounted to the housing 12 about an axis 80 and includes a knife 82 that contacts and cuts the lacing tape 200. The cutting head 24 may be removable and/or replaceable as desired.

As shown in FIGS. 1 and 9-12, a nose piece 202 may be provided at the distal end of the barrel portion 16. In this example, the nose piece 202 defines an aperture 204 through or around which the cable lacing tape 200 may be threaded. The aperture 204 is also sized to receive the housing of the cable lacing device 5. To aid in the alignment of the apparatus 10 and the cable lacing device 5.

As detailed herein, in operation the apparatus 10 is capable of applying a tensioning force to a free end of the cable lacing table 200 of the cable lacing tape device 5. For instance, in this example, the cable lacing tape is fed through or around (e.g., under) the aperture 204 in the nose piece 200 and into the slits 60 in the capstan assembly 17. The trigger 14 may then be actuated to translate the inner plate 32 and the outer plate assembly 34. The capstan assembly 17 is rotated with the outer plate assembly, and the outer capstan 52 and the inner capstan 50 rotate to a misaligned position to grip the lacing tape 200 and to wrap the lacing tape 200 about the outside of the capstan assembly 17.

As the trigger 14, the inner plate 32, the outer plate assembly 34 and the capstan assembly 17 are repeatedly actuated, the cable lacing tape 200 wraps around the outside of the capstan so that the nose piece 202 rests against the cable lacing tape device 5, thereby causing tension in the cable lacing tape 200. Once a predetermined tension is achieved in cable lacing tape 200 a retainer 7 is activated within the cable lacing tie device 5 and actuated into the locked position. In addition, the inner plate 32 and the outer plate assembly 34 move relative to one another to actuate the cutting head 24 to cut the lacing tape 200 to the proper size and remove any excess tape. As a result, the apparatus 10 will both tension and securely actuate the device 5, and further cut the excess tape from the free end 100.

It will be appreciated that the cutting head 24 may be biased in a position wherein the lacing tape 200 is not contacted during normal operation of the apparatus 10. It will be further appreciated that the predetermined tension may be selected, controlled, and/or otherwise adjusted or varied by any suitable manner, including by varying the spring constant of the biasing element, varying the distance between the shoulder of the inner plate and the outer plate assembly, or other suitable manner. In at least one example, the forces associated with the coil spring 40 may be selectively adjusted by any suitable adjustment mechanism to change the biasing force applied by the spring 40 to the inner and outer plates 32, 34.

Figure 13:
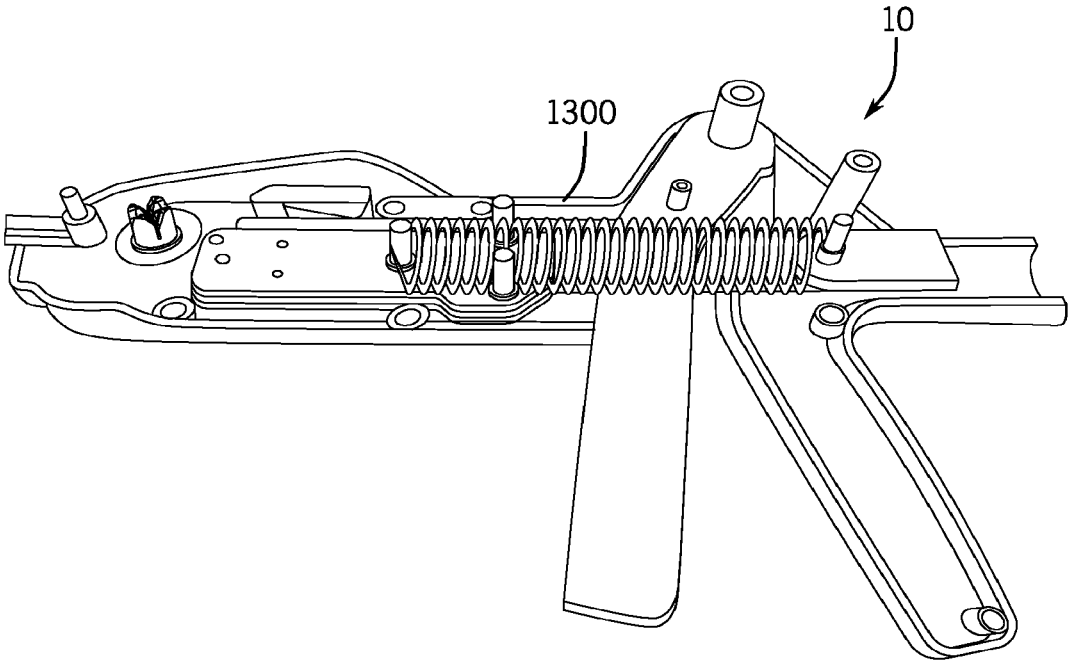
FIG. 13 is a side elevational view of the example apparatus for tensioning a cable lacing tape device as disclosed in FIG. 1, including an extension spring mechanism.

Turning now to FIG. 13, another example apparatus 10' is shown. In this example, the apparatus 10' utilizes multiple extension springs 1300 as opposed to the coil spring 40, but otherwise operates under the same operating principle. It will, therefore, be understood that any suitable biasing mechanism may be utilized to prevent relative movement between the inner plate 32 and the outer plate assembly 34 until the predetermined tension is achieved.

In this example, linearizing the linkage makes the input squeeze force consistent throughout the tool handle stroke. The linear linkages for the blade cutting and the tensioning linkage work in opposite directions. Further, the head nest automatically aligns (see FIGS. 9-10) the head to ensure the force applied to the lace is perpendicular to the fastener making pin activation consistent.

It will be further understood by one of ordinary skill in the art that by optimizing any of the various variables affecting the "gripping" strength of the pinch, such as for instance, the rotational disparity between the inner and outer capstan, and the distance between the surfaces of the inner and outer capstan relative to the thickness of the tape, the surface material composition (e.g., frictional characteristics), and/or any other characteristic, the amount of force created by the pinching action between the inner and outer capstan may be changed as desired.

Although certain example methods and apparatus have been disclosed herein, the scope of coverage of this patent is not limited thereto. On the contrary, this patent covers all methods, apparatus, and articles of manufacture fairly falling within the scope of the appended claims either literally or under the doctrine of equivalents.

We claim:

1. An apparatus for tensioning a cable tape comprising:

a housing;

a driving member reciprocatingly translatably coupled to the housing;

an actuator operably coupled to the housing and to the driving member to cause reciprocating movement of the driving member;

a driven member coupled to the driving member and translatable within the housing;

a biasing element coupled to the driving member and the driven member to exert a biasing force between the driving member and the driven member to cause movement of the driving member to effect translation of the driven member with little or no relative movement between the driving member and the driven member in a first operating mode;

a capstan rotatably coupled to the housing, the capstan having a gripping device to grip a cable tape and wrap the cable tape around an outer surface of the capstan as the capstan rotates; and a ratcheted spur coupled to the driven member and operably coupled to the capstan to rotate the capstan when the driven member translates within the housing;

wherein in a second operating mode, a tension force applied on the capstan by the cable tape that is greater than the biasing force allows relative movement between the driving member and the driven member;

wherein the capstan comprises an inner capstan and an outer capstan rotatable relative to one another, and wherein the inner capstan and the outer capstan comprise a slit and the cable tape is insertable into the slit and wherein relative movement between the inner capstan and the outer capstan misaligns the slit to grip the cable tape.

2. The apparatus of claim 1, wherein each of the driving member and the driven member is a plate.

3. The apparatus of claim 1, further comprising a cutting device operably coupled to the driving member and the driven member such that relative movement between the driving member and the driven member causes the cutting device to move and cut the cable tape.

4. The apparatus of claim 3, wherein the cutting device comprises a pivoting bar operably linked to the driving member and the driven member via a link assembly, a cutting bar proximate the pivoting bar, and a cutting head rotatably coupled to the housing, wherein the pivoting bar moves to engage the cutting bar and the cutting bar causes rotation of the cutting head.

5. The apparatus of claim 4, wherein the cutting bar comprises a ratchet tooth and the ratchet tooth engages the pivoting bar.

6. The apparatus of claim 1, wherein the actuator comprises a trigger pivotably coupled to the housing and wherein pivotable movement of the trigger causes reciprocal translation of the driving member.

7. The apparatus of claim 1, wherein the inner capstan and the outer capstan comprise chamfered edges adjacent the slit to guide the cable tape into the slit.

8. An apparatus for tensioning a cable tape comprising:

a housing;

a driving member reciprocatingly translatably coupled to the housing;

an actuator operably coupled to the housing and to the driving member to cause reciprocating movement of the driving member;

a driven member coupled to the driving member and translatable within the housing;

a biasing element coupled to the driving member and the driven member to exert a biasing force between the driving member and the driven member to cause movement of the driving member to effect translation of the driven member with little or no relative movement between the driving member and the driven member in a first operating mode; and a capstan rotatably coupled to the housing and having an inner capstan and an outer capstan rotatable relative to one another;

wherein the inner capstan and the outer capstan comprise a slit and the cable tape is insertable into the slit wherein relative movement between the inner capstan and the outer capstan misaligns the slit to grip the cable tape.

9. The apparatus of claim 8, further comprising a ratcheted spur coupled to the driven member and operably coupled to the capstan to rotate the capstan when the driven member translates within the housing.

10. The apparatus of claim 8, wherein each of the driving member and the driven member is a plate.

11. The apparatus of claim 8, further comprising a cutting device operably coupled to the driving member and the driven member such that relative movement between the driving member and the driven member causes the cutting device to move and cut the cable tape.

12. The apparatus of claim 11, wherein the cutting device comprises a pivoting bar operably linked to the driving member and the driven member via a link assembly, a cutting bar proximate the pivoting bar, and a cutting head rotatably coupled to the housing, wherein the pivoting bar moves to engage the cutting bar and the cutting bar causes rotation of the cutting head.

13. The apparatus of claim 12, wherein the cutting bar comprises a ratchet tooth and the ratchet tooth engages the cutting bar.

14. The apparatus of claim 8, wherein the inner capstan and the outer capstan comprise chamfered edges adjacent the slit to guide the cable tape into the slit.

15. An apparatus for tensioning a cable tape comprising: a housing; a driving member coupled to the housing; an actuator operably coupled to the housing and to the driving member to cause movement of the driving member; a driven member coupled to the driving member and translatable within the housing; a biasing element coupled to the driving member and the driven member to exert a biasing force between the driving member and the driven member to cause movement of the driving member to effect translation of the driven member; an inner capstan having an inner slit and coupled to the housing; and an outer capstan having an outer slit and rotatable relative to the inner capstan; wherein the cable tape is insertable into the inner and outer slits when aligned and wherein relative movement between the inner capstan and the outer capstan misaligns the inner and outer slits to grip the cable tape.

16. The apparatus of claim 15, further comprising a ratcheted spur coupled to the driven member and operably coupled to rotate at least one of the inner capstan and outer capstan when the driven member translates within the housing.

17. The apparatus of claim 15, wherein each of the driving member and the driven member is a plate.

18. The apparatus of claim 15, further comprising a cutting device operably coupled to the driving member and the driven member such that relative movement between the driving member and the driven member causes the cutting device to move and cut the cable tape.

19. The apparatus of claim 15, wherein the inner capstan and the outer capstan comprise chamfered edges adjacent the slit to guide the cable tape into the slit.

* * * * *